United States Patent [19]

Glanvall

[11] Patent Number: 4,877,380

[45] Date of Patent: Oct. 31, 1989

[54] CONTROL SYSTEM FOR CONTROLLING THE INTERNAL VOLUME IN A ROTARY COMPRESSOR

[75] Inventor: Rune Glanvall, Norrköping, Sweden

[73] Assignee: Stal Refrigeration AB, Norrköping, Sweden

[21] Appl. No.: 162,954

[22] Filed: Mar. 2, 1988

[30] Foreign Application Priority Data

Mar. 4, 1987 [SE] Sweden ..... 8700900

[51] Int. Cl.[4] ..... F04B 49/02; F04C 18/16

[52] U.S. Cl. ..... 417/310; 418/201

[58] Field of Search ..... 418/201 A; 417/310, 417/440

[56] References Cited

U.S. PATENT DOCUMENTS

| | | | |
|---|---|---|---|
| 4,222,716 | 9/1980 | Shaw | 417/310 |
| 4,342,199 | 8/1982 | Shaw et al. | 417/310 X |
| 4,747,755 | 5/1988 | Ohtsuki et al. | 417/310 X |

FOREIGN PATENT DOCUMENTS

| | | | |
|---|---|---|---|
| 1335024 | 10/1973 | United Kingdom | 418/201 A |

*Primary Examiner*—John J. Vrablik
*Assistant Examiner*—Leonard P. Walnoha
*Attorney, Agent, or Firm*—Watson, Cole, Grindle & Watson

[57] ABSTRACT

Adjustable valve bodies are used on the outlet side for controlling the internal volume of a rotary compressor. External control means, often of an extremely complicated nature, have been used to control the internal volume in the rotary compressor. By allowing the different pressure levels of the rotary compressor directly influence a control section (1), the position of the valve body (3) can be controlled by an operating section (2). In the control section a spring pressure and a medium pressure (9) from the compressor are balanced by a plunger (6) against a pressure from the high-pressure side (19) of the compressor. The position of the plunger (6) then determines control of the internal volume via the setting of the valve body (3) connected to the operating device (2).

2 Claims, 7 Drawing Sheets

CONTROL SYSTEM FOR CONTROLLING THE INTERNAL VOLUME IN A ROTARY COMPRESSOR

TECHNICAL FIELD

The present invention relates to a control system for controlling the internal volume in a rotary compressor with respect to the load requirement in order to achieve optimum efficiency. The internal volume in the rotary compressor of a cooling or heating pump system is controlled by means of one or more displaceable valve bodies, to allow adjustment of the pressure ratio in the compressor.

BACKGROUND ART

The built-in or internal volume of a rotary compressor should maintain a specific ratio relation to the pressure ratio of the compressor if optimum efficiency is to be obtained. It must therefore be possible to vary the internal volume depending on whether full load or partial load prevails. The internal volume can be controlled, for instance, by an axially adjustably slide. Stepwise control can be obtained by using several radially adjustable air valves, for instance. Stepless control of the internal volume, however, usually requires an extremely complicated control system which may comprise a hydraulic system with solenoid valves and some form of calculating unit, e.g. a processor, which controls the solenoid valves depending on the prvailing pressure ratio. The solenoid valves in the hydraulic system are opened or closed to allow different pressure levels access to a hydraulic motor connected to an adjustable slide, for instance, to position this and thus control the internal volume.

DISCLOSURE OF THE INVENTION

To enable control of the internal volume in a rotary compressor without the use of external control means, a control system has been devised which, depending on the various pressure levels of the compressor, controls the position of one or more valve bodies on the outlet side. By using a medium pressure from the compressor and allowing this, together with a spring pressure, to be balanced against a pressure level from the high-pressure side of the compressor in a control section, the position of the valve body can be adjusted to suit the internal volume by means of an operating section connected to the control section.

DESCRIPTION OF A PREFERRED EMBODIMENT

Figure 1:
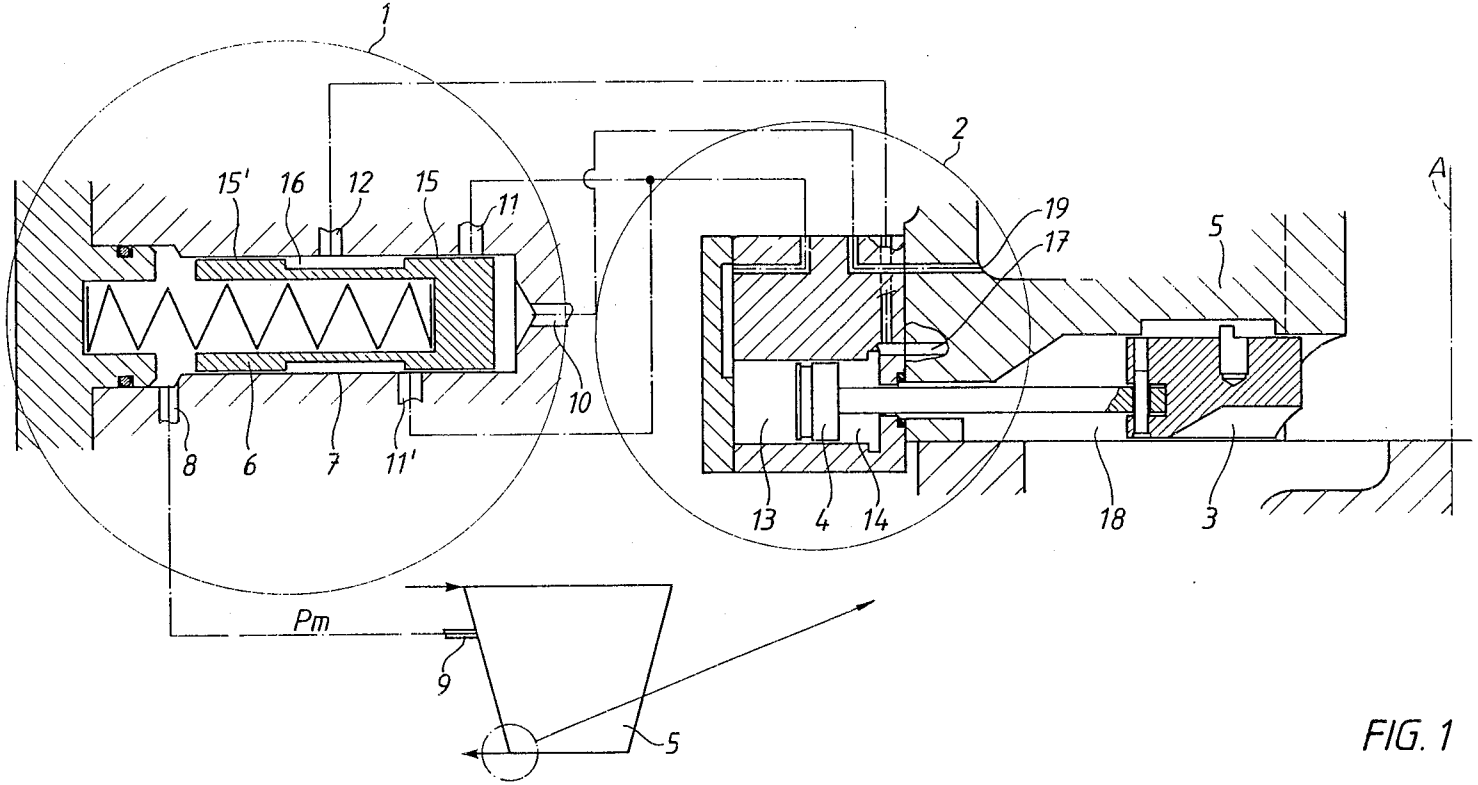
FIG. 1 shows a control system for controlling the internal volume of a rotary compressor.

The control system for controlling the internal volume of a rotary compressor according to the invention comprises a control section 1 and an operating section 2 connected to a valve body 3 for controlling the internal volume it the rotary compressor. The control section 1 comprises a cylindrical space 7 in which an axial plunger 6 is movable under the influence of a spring force and fluid pressure. When the plunger 6 moves in the cylindrical space 7, a part of the peripheral surface 15 of the plunger will expose or close openings 11, 11' in the wall of the cylindrical space 7. A spring force and a fluid pressure operate on one end surface of the plunger, corresponding to a medium pressure deriving from the outlet port 9 of the operating chamber of the rotary compressor. This fluid pressure is supplied to the cylindrical space through an opening 8 in the wall at its end surface on the spring side. At the other end surface of the plunger a fluid pressure is exerted deriving from the high-pressure side 19 of the rotary compressor, where the fluid pressure is supplied to the cylindrical space 7 through an opening 10 in the end surface of the cylindrical space opposite the spring side. The plunger is shaped to have a central point 16 with a smaller diameter than the diameter of the surrounding end parts 15, 15' of the piston 6. An opening 12 is arranged centrally in the wall of the cylindrical space, to allow access of fluid from the low-pressure side 17 of the rotary compressor to the space between the cylinder wall and the narrower midsection 16 of the plunger. The openings 11, 11' in the cylinder wall are spaced apart and located between the central opening 12 and the end surface with the opening 10. The distance between the openings 11 and 11' and the length of the end 15 of the plunger is chosen so that the plunger can only simultaneously expose one of the openings 11 and 11' and close the other. The openings 11 and 11' may possibly comprise a single connection, but the arrangement of two axially displaceable openings offers a longer sealing surface 15 on the plunger 6. The openings 11, 11' are connected to the plungercylinder arrangement of the operating section 2. The operating section 2 consists of a plunger-cylinder arrangement in which the piston-rod of the plunger 4 is connected to the valve body 3 to control the internal volume in the rotary compressor 5. The cylindrical space on the pistonrod side 14 is connected to the low-pressure side 17 of the rotary compressor. The cylindrical space is connected at its opposite end 13 to one of the two openings 11, 11' in the above-mentioned cylindrical space 17. The valve body 3 may be radially movable, relation to the axis of the rotors acting in an outlet gate to the operating chamber of the rotary compressor, and may have a substantially triangular cross section, its end surface abutting the rotors of the rotary compressor with minimum clearance when fully inserted. The valve body may also be designed as part of the plunger. With such an arragement control can be effected using several valve bodies.

A rotary compressor operates optimally when the pressure and volume are in a certain ratio to each other: $P1/P2 = V_i^n$. At varying operating conditions it is important that the internal volume can be adjusted to the prevailing conditions. This can be achieved steplessly or stepwise, stepwise control being considerably simpler to achieve that stepless control. However, stepwise control will often give such a good adaptation that the continuous, stepless control function cannot normally be considered justified when taking into account the output and the complicated construction.

Figure 2:
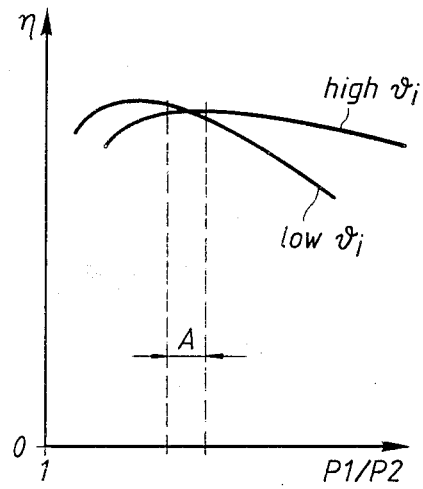
FIG. 2 shows in principle total efficiency curves for a screw compressor with different internal volumes $V_1$.
Figure 3:
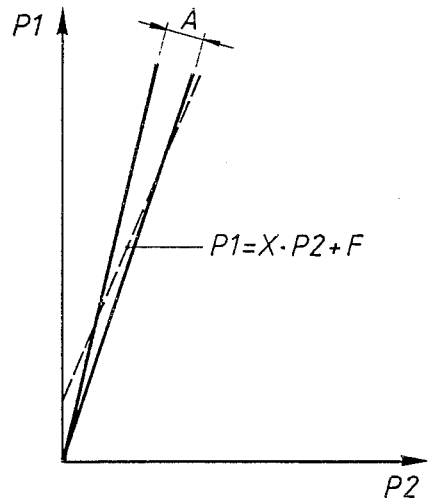
FIG. 3 shows inprinciple a changeover region in a P1/P2 diagram.

For stepwise control the pressure at which changeover shall occur between the various internal volumes must be determined. FIG. 2 shows in principle the total efficiency curves for a screw compressor with various internal volumes ($V_i$). The changeover should occur within an area "A" in order to achieve highest efficiency, since the differences in efficiency for operating conditions within this area are small between different internal volumes. FIG. 3 shows in principle the corresponding changeover area in a P1/P2 diagram. A suitable choice of medium pressure PM (Pm =f(P2)) and spring force F will give a changeover boundary corresponding well to the area "A". FIG. 3 also illustrates that, by altering the spring force F, e.g. with washers, the boundary line can be parallel-displaced. To further optimize the process, the incline within the relevant operating limits can be changed by changing Pm. However, this is considerably more difficult in practice.

Figure 4:
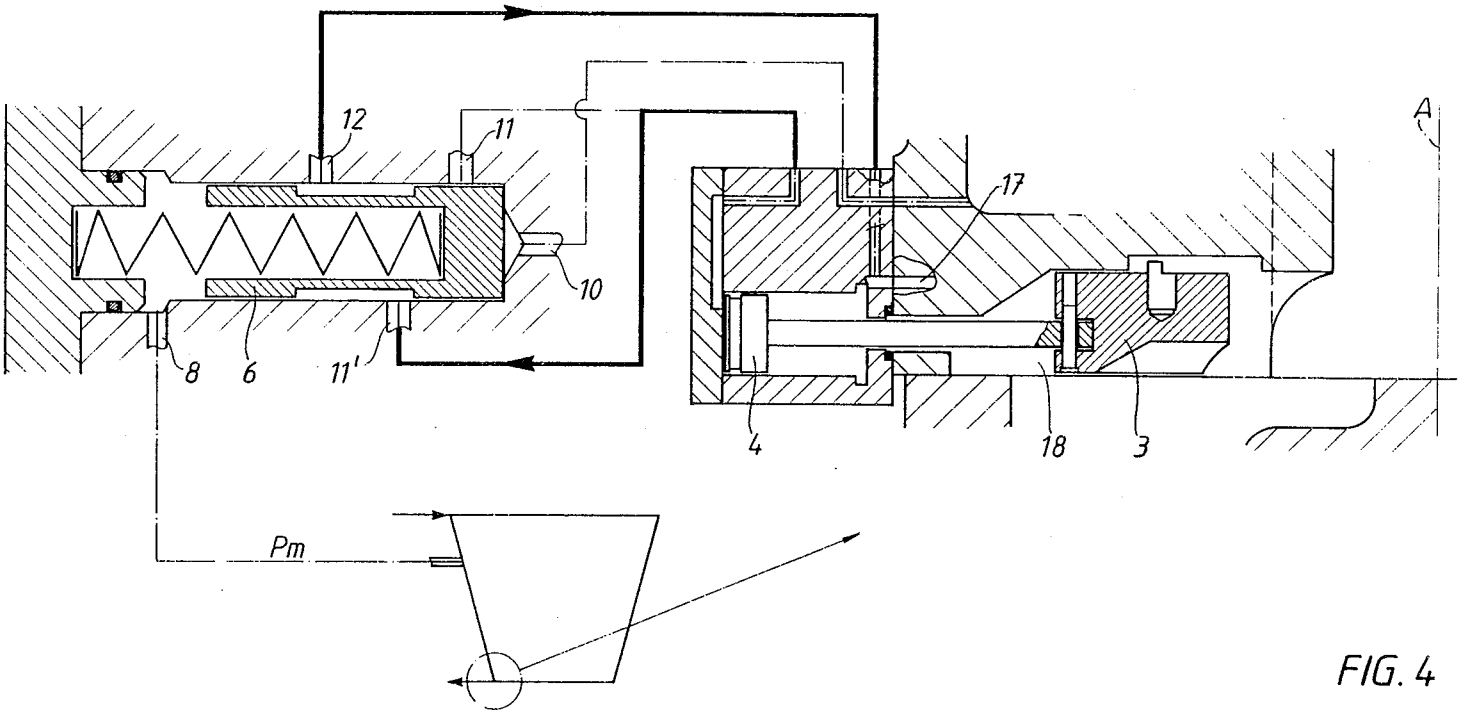
FIGS. 4–7 show various control conditions in the control system.
Figure 5:
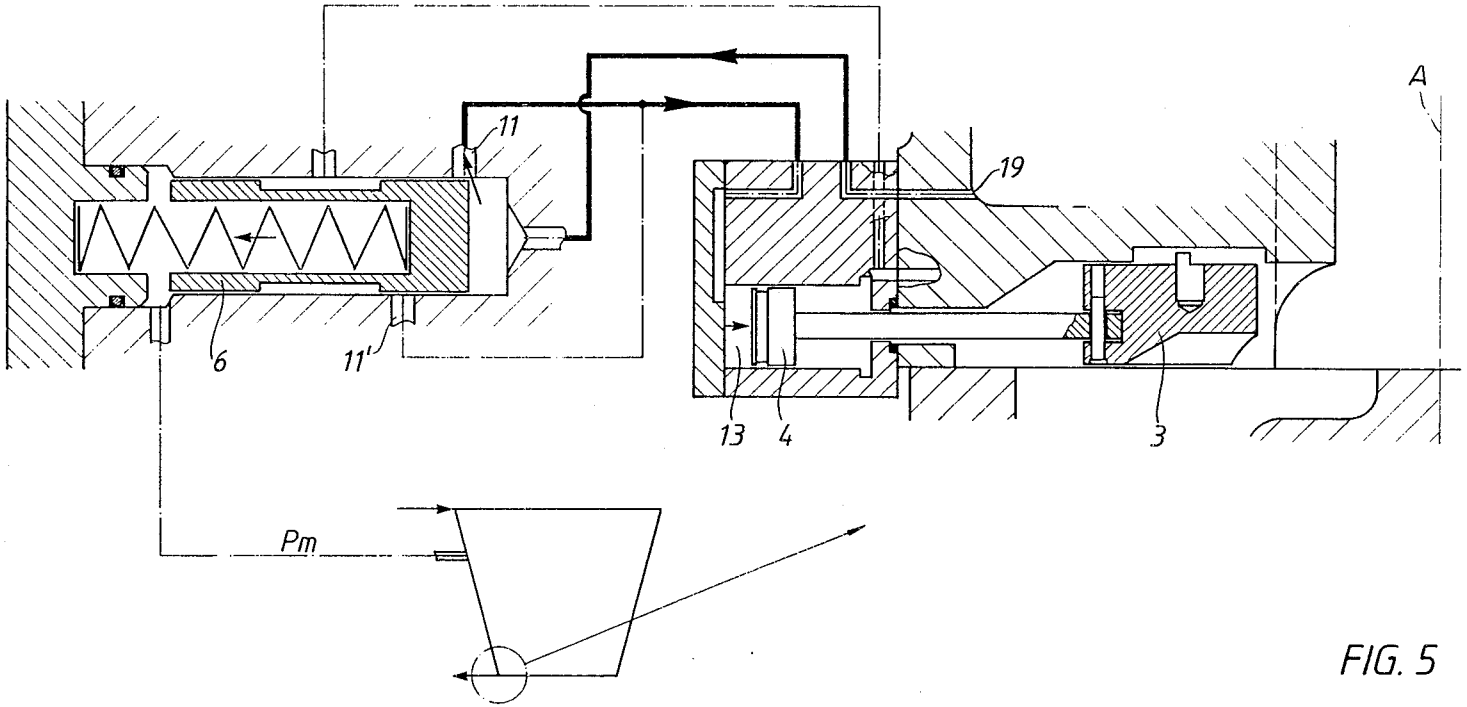
Figure 6:
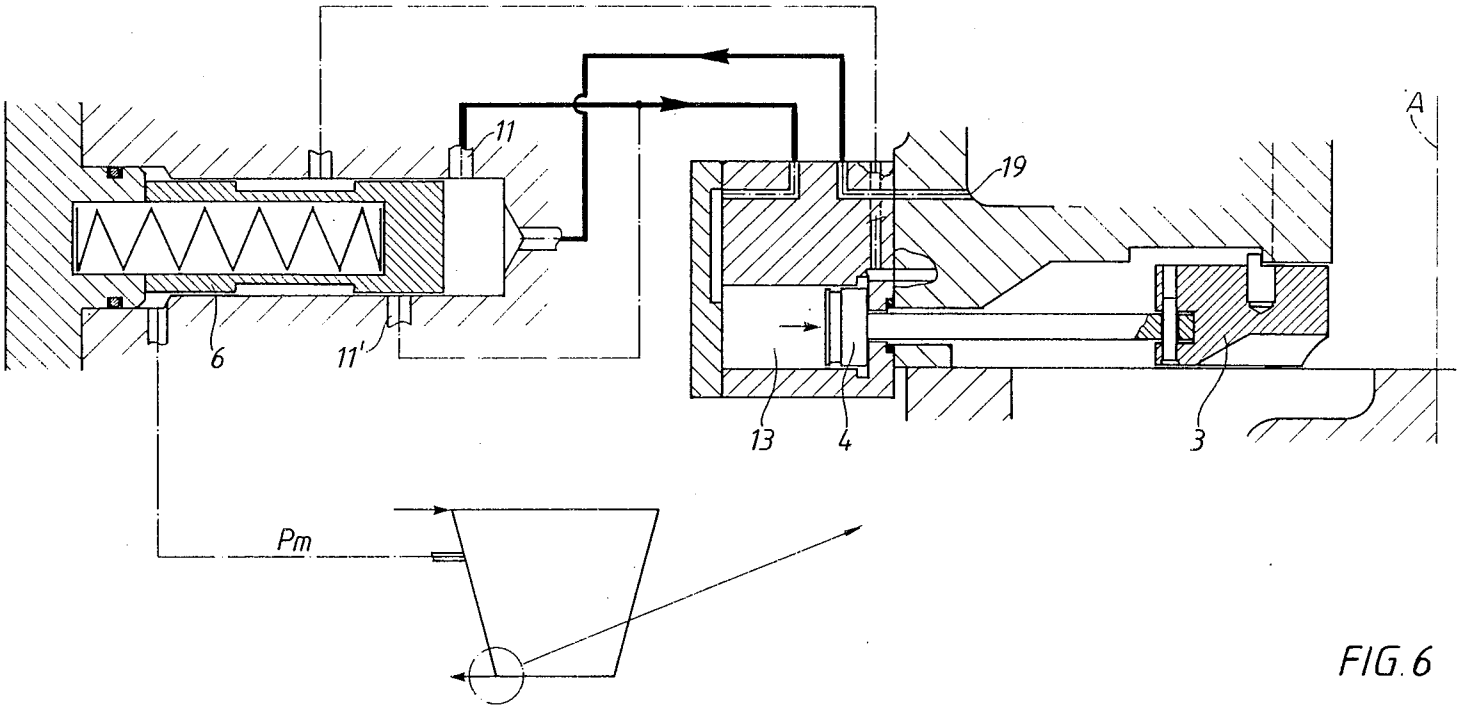
Figure 7:
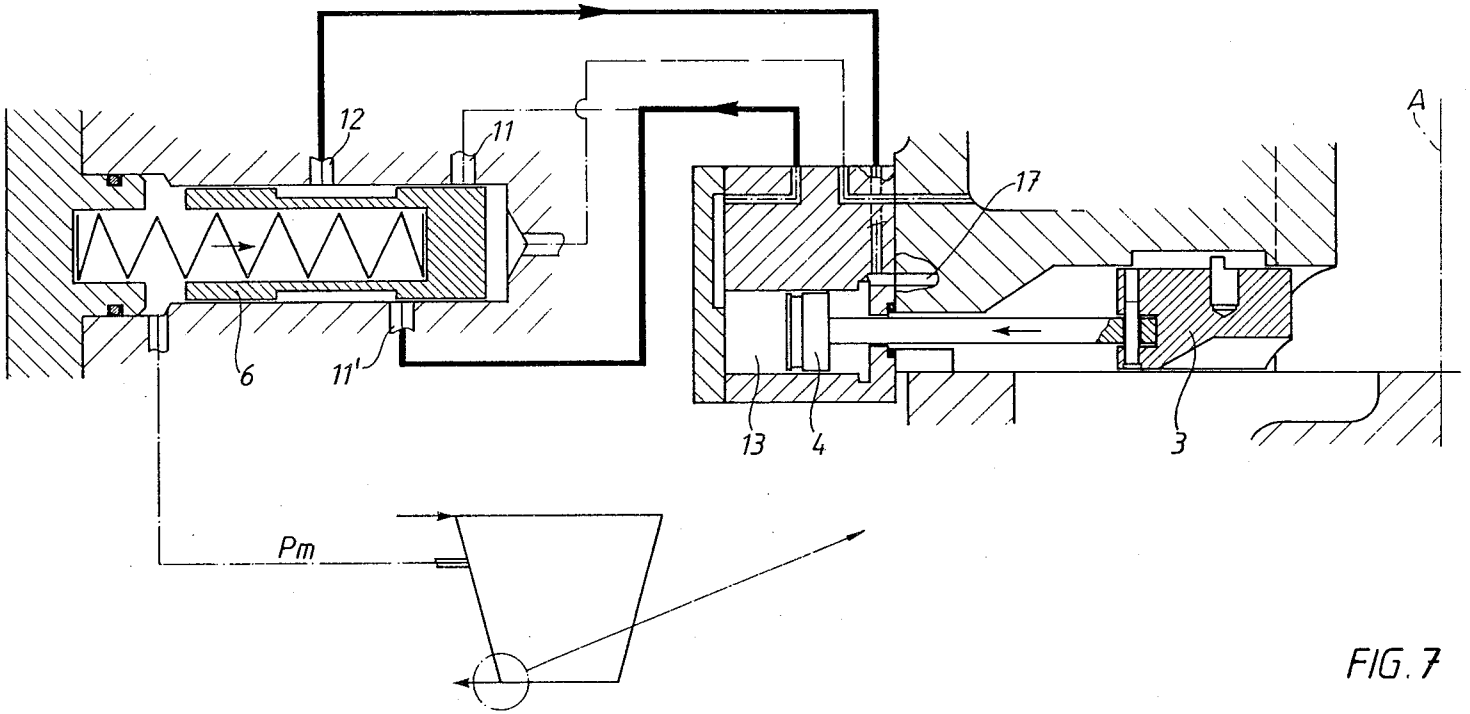

FIGS. 4–7 show how the control system functions under different operation conditions. When the pressure P from the system in opening 10 is lower than the medium pressure Pm and the spring pressure F, i.e., P is less than Pm+F, as in FIG. 4, the plunger 6 will assume a position blocking the opening 11 and exposing the openings 11', the opening 11' thus communicating with the low-pressure side through the opening 12. The outlet pressure of the compressor at 18 then forces the valve body 3 with plunger 4 to an outer position, corresponding to low internal volume. When P1 increases and/or P2 decreases, corresponding to a higher P1/P2, the pressure will increase on the high-pressure side 19 and the plunger 6 will be forced to the left in FIG. 5, thus closing opening 11' and exposing opening 11. The high pressure from 19 will then be conveyed to the cylinder space 13, thus forcing the plunger 4 to the right. The valve body 3 connected to the plunger 4 will be moved towards a closed position. In FIG. 6 the plunger 4 has reached its end position and the valve body 3 has reached a position for a state of high internal volume. FIG. 7 shows a return to a state of low internal volume, when the pressure on the high-pressure side drops. The medium pressure and spring pressure are then greater than the pressure from the high-pressure side. The plunger moves to the left. The cylinder space 13 in the plunger-cylinder arrangement communicates with the low-pressure side 17, whereupon the plunger 4 with valve body 3 moves to the left towards a state of low internal volume.

Under partial load the medium pressure from the outlet port 9 wil be lower than under full load, as illustrated in FIGS. 5 and 6. The plunger 6 has been moved to the left, allowing fluid to flow into the cylinder space 13. The valve body 3 is thus moved to a position corresponding to high internal pressure, which is particularly desirable in order to adjust the internal volume to partial load.

When the compressor is stopped the pressures will be equalized and the spring then forces the plunger 6 to the right in FIG. 4. Cylinder 13 in the operating part is then connected to the low-pressure side 17 of the compressor. At a subsequent start, the valve body 3 is in a position for low internal volume. This means that the compressor will also start in a position requiring the lowest start torque.

The control section 1 in the described control system thus controls the operating section to a desired position for full load and partial load, as well as for stopping and starting, without any external control means.

Figure 8:
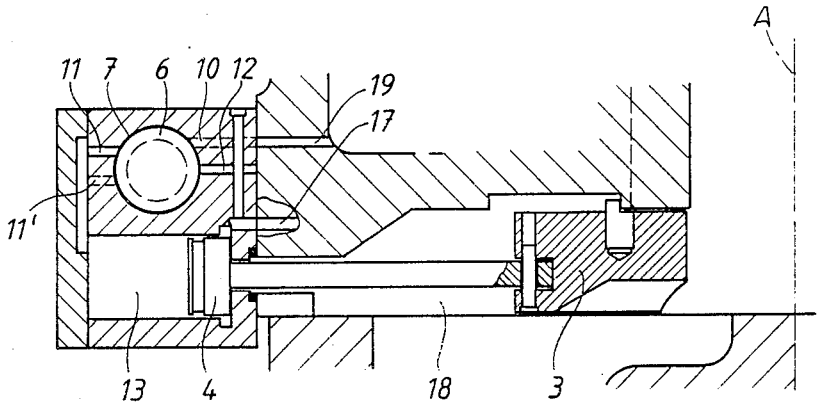
FIG. 8 shows a system for controlling the internal volume, integrated with the rotary compressor.

In an alternative embodiment according to FIG. 8 the control section and operating section with valve body are integrated with the compressor housing to give a more compact construction. The plunger 6 of the control section 1 is here arranged immediatey above the operating section's plunger-cylinder arrangement, which is in turn in direct connection with the outlet side of the compressor housing.

I claim:

1. A control system for controlling the positioning of a valve body with respect to an outlet gate of an operating chamber of a rotary compressor to thereby adjust the internal volume of the rotary compressor, said rotary compressor providing a first outlet port for fluid medium at a low pressure, a second outlet port for fluid medium at a high pressure and a third outlet port for fluid medium at an intermediate pressure, said control system comprising an operating device which includes a housing means forming a cylindrical operating chamber; a piston which is movable within said operating chamber and which divides said operating chamber into first and second chamber spaces; a piston rod which extends from said piston through said second chamber space and connects with said valve body; said second chamber space communicating with said first outlet port of said rotary compressor, a control device which includes a housing means forming a cylindrical control chamber having first and second ends, said housing means providing a first opening communicating with said control chamber near said first end thereof, a second opening communcating with said control chamber about halfway between said first and second ends thereof, third and fourth openings communicating with said control chamber near said second end thereof, and a fifth opening at said second end of said control chamber; a plunger which is movable within said control chamber, said plunger having a first end portion which faces said first end of said control chamber, an opposite second end portion which can block said third and fourth openings, and a middle portion of reduced diameter which is in register with said second opening, and spring means biasing said plunger towards said second end of said control chamber, first conduit means connecting said first opening with said third outlet port, second conduit means connecting said second opening with said first outlet port, third conduit means connecting said third and fourth openings with said first chamber space of said operating device, and fourth conduit means connecting said fifth opening with said second outlet port, the positioning of said valve body being determined by the relative pressures of fluid medium in said first and second chamber spaces of said operating chamber, which in turn is controlled by the positioning of the plunger in said control chamber.

2. A control system as claimed in claim 1, wherein said control device and said operating device are integral with the rotary compressor.

* * * * *